US008522378B2

(12) United States Patent
Argento

(10) Patent No.: US 8,522,378 B2
(45) Date of Patent: Sep. 3, 2013

(54) AESTHETICALLY AND SIZE CUSTOMIZABLE SHEET/BLANKET/SPREAD/COMFORTER FOR A BED

(76) Inventor: Virginia A. Argento, Brooklyn, NY (US)

( * ) Notice: Subject to any disclaimer, the term of this patent is extended or adjusted under 35 U.S.C. 154(b) by 101 days.

(21) Appl. No.: 13/065,733

(22) Filed: Mar. 29, 2011

(65) Prior Publication Data

US 2012/0246828 A1 Oct. 4, 2012

(51) Int. Cl.
*A47G 9/04* (2006.01)
*A47G 9/02* (2006.01)

(52) U.S. Cl.
USPC ..... 5/486; 5/502; 5/482

(58) Field of Classification Search
USPC ..... 5/486, 502, 482, 417, 420, 413 R, 5/641; D6/603
See application file for complete search history.

(56) References Cited

U.S. PATENT DOCUMENTS

| | | | | | |
|---|---|---|---|---|---|
| 1,267,042 | A | * | 5/1918 | Arnold | 5/486 |
| 1,885,558 | A | * | 11/1932 | Smith | 128/872 |
| 2,808,596 | A | * | 10/1957 | Schreiner | 5/486 |
| 3,508,285 | A | * | 4/1970 | Marquette | 5/486 |
| 3,510,889 | A | * | 5/1970 | Peterson | 5/413 R |
| 3,530,516 | A | * | 9/1970 | Marquette | 5/486 |
| 3,808,648 | A | | 5/1974 | Billarant et al. | |
| 4,005,499 | A | * | 2/1977 | Klein | 5/485 |
| 4,488,323 | A | | 12/1984 | Colburn | |
| 4,573,227 | A | * | 3/1986 | Prandina | 5/486 |
| 4,615,061 | A | | 10/1986 | Scott | |
| 4,631,765 | A | * | 12/1986 | Casey | 5/417 |
| 4,800,602 | A | * | 1/1989 | Luery | 5/417 |
| 4,922,565 | A | | 5/1990 | Blake | |
| 5,251,350 | A | * | 10/1993 | Bordenave et al. | 5/482 |
| 5,330,806 | A | * | 7/1994 | Bythewood et al. | 428/33 |
| D376,720 | S | * | 12/1996 | Thode et al. | D6/603 |
| 5,713,089 | A | * | 2/1998 | Ferrante | 5/502 |
| 5,887,299 | A | * | 3/1999 | Phillips | 5/413 R |
| 5,970,541 | A | * | 10/1999 | Chiang | 5/420 |
| 6,226,814 | B1 | | 5/2001 | Alexander | |
| 6,443,794 | B2 | * | 9/2002 | Oren et al. | 446/85 |
| 6,698,043 | B2 | | 3/2004 | Fabian | |
| 6,862,760 | B2 | * | 3/2005 | Bradley et al. | 5/486 |
| D552,909 | S | * | 10/2007 | McGrath et al. | D6/582 |
| 7,406,728 | B2 | * | 8/2008 | VanNeste | 5/486 |
| 7,533,427 | B2 | * | 5/2009 | Jackson | 5/486 |
| 7,676,864 | B2 | * | 3/2010 | Lee | 5/502 |
| 8,132,433 | B2 | * | 3/2012 | Andersen | 68/235 R |
| 2003/0217411 | A1 | * | 11/2003 | Bradley et al. | 5/486 |
| 2007/0061967 | A1 | | 3/2007 | Fox | |
| 2007/0226905 | A1 | * | 10/2007 | VanNeste | 5/486 |
| 2008/0092346 | A1 | * | 4/2008 | Andersen | 24/429 |
| 2008/0313809 | A1 | * | 12/2008 | Inman, II | 5/486 |
| 2009/0044336 | A1 | * | 2/2009 | Jackson | 5/486 |
| 2009/0249547 | A1 | * | 10/2009 | Lee | 5/400 |
| 2011/0283487 | A1 | * | 11/2011 | Koenigkramer et al. | 24/389 |
| 2012/0246828 | A1 | * | 10/2012 | Argento | 5/486 |
| 2013/0014325 | A1 | * | 1/2013 | Argento | 5/417 |

* cited by examiner

*Primary Examiner* — Robert G Santos
(74) *Attorney, Agent, or Firm* — Richard L. Miller

(57) ABSTRACT

An aesthetically and size customizable sheet/blanket/spread/comforter for a bed, which includes at least two sheet sections, and apparatus for interchangeably attaching the at least two sheet sections to each other edge-to-edge to form a generally coplanar sheet so as to allow the generally coplanar sheet to be size customizable. The at least two sheet sections are interchangeably attached to each other edge-to-edge to form the generally coplanar sheet so as to allow the generally coplanar sheet to be size customizable. The at least two sheet sections have decorative patterns thereon so as to allow the generally coplanar sheet to be aesthetically customizable.

10 Claims, 7 Drawing Sheets

FIG. 7
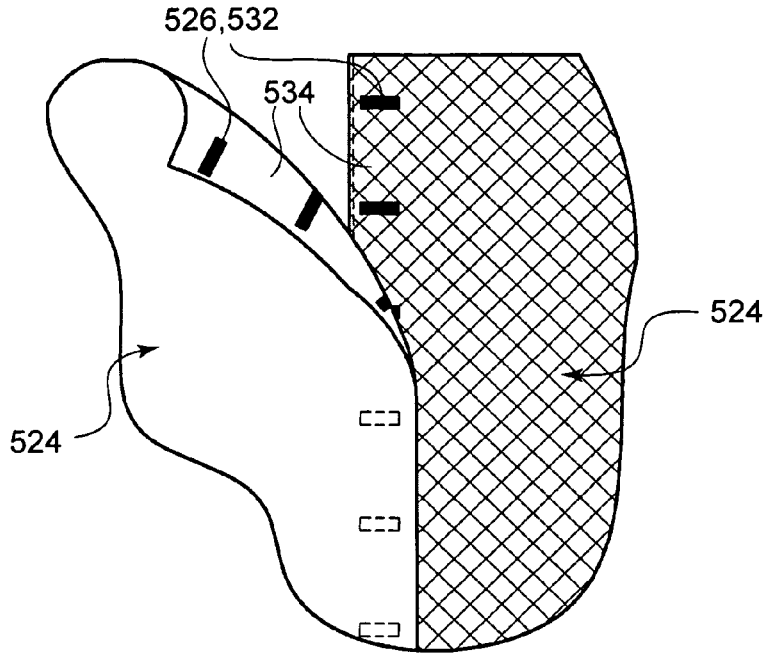
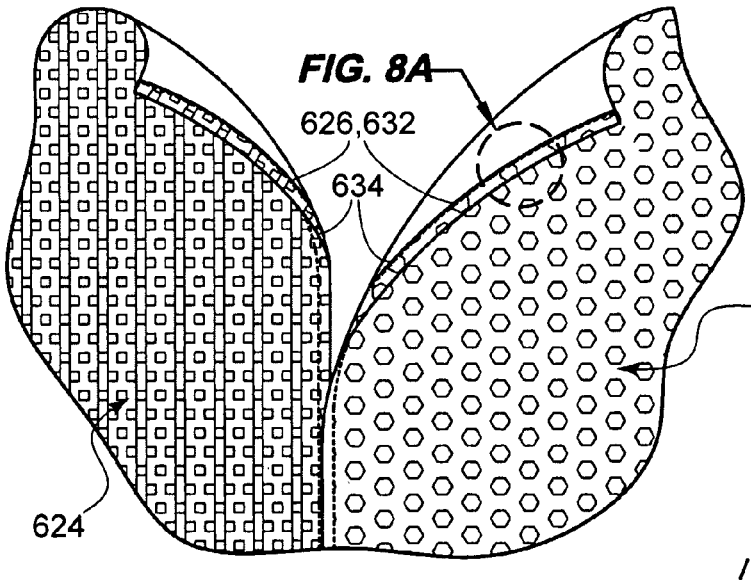
FIG. 8
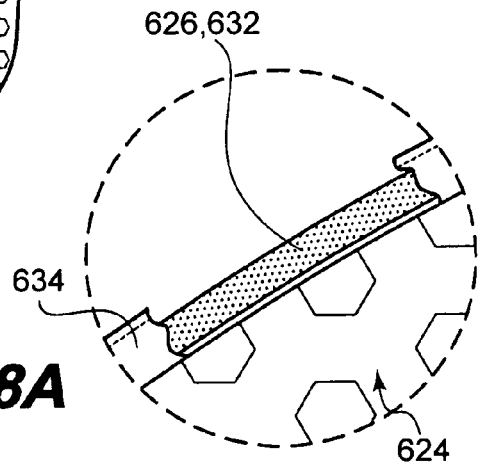
FIG. 8A

AESTHETICALLY AND SIZE CUSTOMIZABLE SHEET/BLANKET/SPREAD/COMFORTER FOR A BED

1. BACKGROUND OF THE INVENTION

A. Field of the Invention

An embodiment of the present invention relates to a sheet/blanket/spread/comforter for a bed, and more particularly, an embodiment of the present invention relates to an aesthetically and size customizable sheet/blanket/spread/comforter for a bed.

B. Description of the Prior Art

Numerous innovations for bed coverings have been provided in the prior art, which will be described below in chronological order to show advancement in the art, and which are incorporated herein by reference thereto. Even though these innovations may be suitable for the specific individual purposes to which they address, however, they differ from the present invention in that they do not teach an aesthetically and size customizable sheet/blanket/spread/comforter for a bed.

(1) U.S. Pat. No. 3,808,648 to Billarant et al.

U.S. Pat. No. 3,808,648 issued to Billarant et al. on May 7, 1974 in U.S. class 24 and subclass 450 teaches a separable fastening sheet having clasping elements that are designed to co-operate with corresponding clasping elements of another sheet and at least some of which have at their end an enlarged or bulbous terminal head connected to the base by a stem, web, or foot. The heads of at least part of these elements have a widened head having at least one flexible lip or edge adapted to bend with respect to the remainder of the element for penetration of the heads between or into the corresponding elements of the other sheet and the locking thereof by the last-mentioned elements by elastic retraction of said lip on contact thereof with the corresponding elements and its at least partial return to its position of rest.

(2) U.S. Pat. No. 4,488,323 to Colburn.

U.S. Pat. No. 4,488,323 issued to Colburn on Dec. 18, 1984 in U.S. class 5 and subclass 692 teaches bedding including a pair of strips of hook and loop fastening material attached to and circumscribe the side of a mattress. The strips are positioned on the side of the mattress, one above the other. Strips of hook and loop fastening material are also attached to the undersurfaces and near the outer peripheral edges of top and bottom sheets on the mattress. The bottom sheet is smaller than the top sheet so that the strip of fastening material on the bottom sheet is attached to the upper strip of fastening material on the side of the mattress. The strip of fastening material on the top sheet is attached to the lower strip of fastening material on the side of the mattress. The strips of fastening material attached to the undersurfaces of the top and bottom sheets are fabricated from hook material and the strips of fastening material attached to the side of the mattress fabricated from loop material, or vice versa.

(3) U.S. Pat. No. 4,615,061 to Scott.

U.S. Pat. No. 4,615,061 issued to Scott on Oct. 7, 1986 in U.S. class 5 and subclass 497 teaches a bed sheet combination including under and upper sheets attached together by an elongated interlocking assembly extending along foot portions of the sheets. The sides of the sheets are free of connecting apparatus for speed of interconnecting of the under and upper sheets. Both sheets have pocketed foot-ends. The pockets of the upper sheet are for protecting the elongated interlocking assembly from stress from sheet-tugging. The pockets of the upper sheet have elastic edges to provide pockets that expand for speedy attachment to a mattress.

(4) U.S. Pat. No. 4,922,565 to Blake.

U.S. Pat. No. 4,922,565 issued to Blake on May 8, 1990 in U.S. class 5 and subclass 484 teaches a composite bottom sheet or crib sheet includes a first moisture proof panel overlying the mattress with a surface comfortable for a user and a second panel subjacent the first panel and extending under the mattress during use. Hook and loop fasteners intermesh on top of the mattress to connect the two panels and permit removal of the moisture proof panel when soiled.

(5) U.S. Pat. No. 6,226,814 to Alexander.

U.S. Pat. No. 6,226,814 issued to Alexander on May 8, 2001 in U.S. class 5 and subclass 486 teaches a separable bed covering including a pair of rectangular sheets, each having a short upper edge, a short lower edge, a long inner edge, and a long outer edge. The long inner edge of a first sheet has a hook and loop strip extending therealong, on a bottom surface thereof. The long inner edge of a second sheet has a hook and loop strip extending therealong, on a top surface thereof for mating with the hook and loop strip of the first sheet to form a single large sheet. A supplemental sheet connects the first sheet to the second sheet. The supplemental sheet has a first edge fixedly secured to the long inner edge of the first sheet. A second edge of the supplemental sheet has a hook and loop strip disposed thereon for mating with a second hook and loop strip on a central portion of the second sheet.

(6) U.S. Pat. No. 6,698,043 to Fabian.

U.S. Pat. No. 6,698,043 issued to Fabian on Mar. 2, 2004 in U.S. class 5 and subclass 486 teaches a split bed covering for more than one user, which is capable of providing different warmth characteristics to each of the users. The covering includes a first sheet having a top portion, a bottom portion, and an inner edge portion. The covering also includes a second sheet having a top portion, a bottom portion, and an inner edge portion. An overlapping portion is formed by the inner edge portions of the first and second sheets. These inner edge portions are capable of being interchangeably positioned one on top of the other. A joining device joins the overlapping portions at the bottom portion of the first sheet and the bottom portion of the second sheet to form a joined portion. This joined portion has a predetermined length that allows for complete removal of one of the first and/or second sheets from at least one of the users.

(7) United States Patent Application Publication Number 2007/0061967 to Fox.

United States Patent Application Publication Number 2007/0061967 published to Fox on Mar. 22, 2007 in U.S. class 5 and subclass 486 teaches a bed cover for use with two persons sharing a bed. The bed cover includes at least one of a sheet, blanket, spread, and comforter. The bed cover features a split substantially down a center of the bed cover for a predetermined distance, so that each person sharing the bed could have an individual preference of being one of covered and uncovered.

It is apparent that numerous innovations for bed coverings have been provided in the prior art that are adapted to be used. Furthermore, even though these innovations may be suitable for the specific individual purposes to which they address, however, they would not be suitable for the purposes of the embodiments of the present invention as heretofore described, namely, an aesthetically and size customizable sheet/blanket/spread/comforter for a bed.

2. SUMMARY OF THE INVENTION

Thus, an object of the embodiments of the present invention is to provide an aesthetically and size customizable sheet/blanket/spread/comforter for a bed, which avoids the disadvantages of the prior art.

Briefly stated, another object of the embodiments of the present invention is to provide an aesthetically and size customizable sheet/blanket/spread/comforter for a bed, which includes at least two sheet sections, and apparatus for interchangeably attaching the at least two sheet sections to each other edge-to-edge to form a generally coplanar sheet so as to allow the generally coplanar sheet to be size customizable. The at least two sheet sections are interchangeably attached to each other edge-to-edge to form the generally coplanar sheet so as to allow the generally coplanar sheet to be size customizable. The at least two sheet sections have decorative patterns thereon so as to allow the generally coplanar sheet to be aesthetically customizable.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

The figures of the drawing are briefly described as follows:

FIG. 7 is a diagrammatic perspective view of a set of individual magnet fastener mechanisms of the attaching apparatus of the present invention identified by ARROW 7 in FIG. 1;

FIG. 8 is a diagrammatic perspective view of a fastening tape mechanism of the attaching apparatus of the present invention identified by ARROW 8 in FIG. 1;

FIG. 8A is an enlarged diagrammatic plan view of the area generally enclosed by the dotted curve identified by ARROW 8A in FIG. 8;

4. LIST OF REFERENCE NUMERALS UTILIZED IN THE FIGURES OF THE DRAWING

A. General

Figure 1:
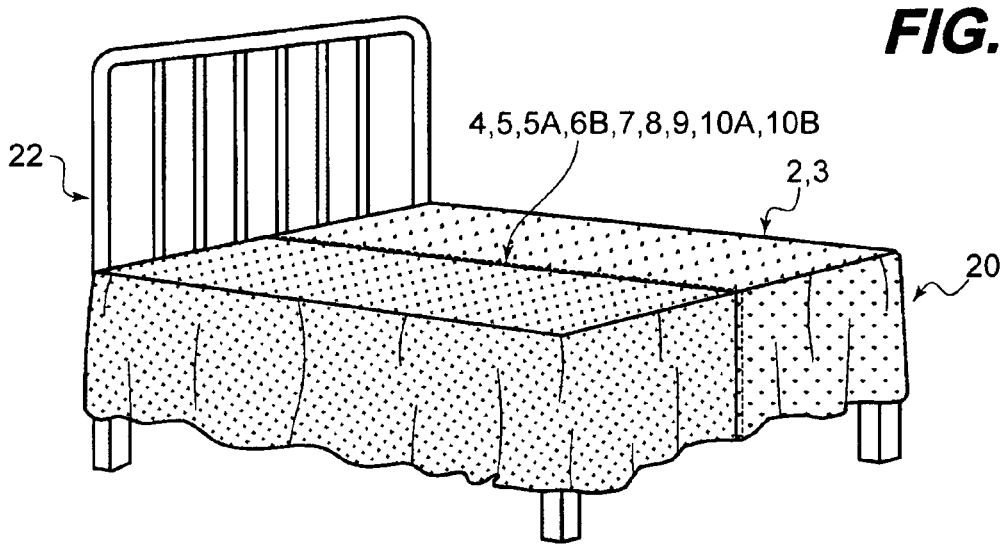
FIG. 1 is a diagrammatic perspective view of the aesthetically and size customizable sheet/blanket/spread/comforter of an embodiment of the present invention on a bed.

20 aesthetically and size customizable sheet/blanket/spread/comforter of embodiment of present invention for bed 22
22 bed

B. Overall Configuration of Ascetically and Size Customizable Sheet/Blanket/Spread/Comforter 20

24 at least two sheet sections
26 attaching apparatus for interchangeably attaching at least two sheet sections 24 to each other edge-to-edge to form generally coplanar sheet 28 so as to allow generally coplanar sheet 28 to be size customizable
28 generally coplanar sheet
30 decorative patterns on at least two sheet sections 24

C. Specific Configuration of First Embodiment of Attaching Apparatus 126

124 at least two sheet sections
126 attaching apparatus
132 magnetic tape mechanism of attaching apparatus 126
134 adjoining edges of at least two sheet sections 124

D. Specific Configuration of Second Embodiment of Attaching Apparatus 226

224 at least two sheet sections
226 attaching apparatus
232 set of button and button hole mechanisms of attaching apparatus 226
234 adjoining edges of at least two sheet sections 224

E. Specific Configuration of Third Embodiment of Attaching Apparatus 326

324 at least two sheet sections
326 attaching apparatus
332 hidden set of snap fastener mechanisms of attaching apparatus 326
334 adjoining edges of at least two sheet sections 324

F. Specific Configuration of Fourth Embodiment of Attaching Apparatus 426

424 at least two sheet sections
426 attaching apparatus

432 decorative set of snap fastener mechanisms of attaching apparatus 426
434 adjoining edges of at least two sheet sections 424

G. Specific Configuration of Fifth Embodiment of Attaching Apparatus 526

524 at least two sheet sections
526 attaching apparatus
532 set of individual magnet fastener mechanisms of attaching apparatus 526
534 adjoining edges of at least two sheet sections 524

H. Specific Configuration of Sixth Embodiment of Attaching Apparatus 626

624 at least two sheet sections
626 attaching apparatus
632 fastening tape mechanism of attaching apparatus 626
634 adjoining edges of at least two sheet sections 624

I. Specific Configuration of Seventh Embodiment of Attaching Apparatus 726

724 at least two sheet sections
726 attaching apparatus
732 set of individual hook and eye mechanisms of attaching apparatus 726
734 adjoining edges of at least two sheet sections 724

J. Specific Configuration of Eighth Embodiment of Attaching Apparatus 826

824 at least two sheet sections
826 attaching apparatus
832 mechanical slide fastener mechanism of attaching apparatus 826
834 adjoining edges of at least two sheet sections 824

K. Specific Configuration of Ninth Embodiment of Attaching Apparatus 926

924 at least two sheet sections
926 attaching apparatus
932 mechanical slide fastener mechanism covered by decorative patches/sachets 936 of attaching apparatus 926
936 decorative patches/sachets of attaching apparatus 926
934 adjoining edges of at least two sheet sections 924

L. Specific Configuration of First Embodiment of the Decorative Patches/Sachets 950

950 decorative patches/sachets
951 Happy Birthday patch/sachet of decorative patches/sachets 950
952 Saint Patty's Day patch/sachet of decorative patches/sachets 950
953 gift patch/sachet of decorative patches/sachets 950
954 Christmas wreath patch/sachet of decorative patches/sachets 950
955 Valentine's Day patch/sachet of decorative patches/sachets 950
956 Happy Holiday patch/sachet of decorative patches/sachets 950

M. Specific Configuration of Second Embodiment of Decorative Patches/Sachets 960

960 decorative patches/sachets
961 Lady Bug patch/sachet of decorative patches/sachets 960
962 Butterfly patch/sachet of decorative patches/sachets 960
963 worm of decorative patches/sachets 960

N. Specific Configuration of Third Embodiment of Decorative Patches/Sachets 970

970 decorative patches/sachets
971 pillows of decorative patches/sachets 970

O. Specific Configuration of Fourth Embodiment of Decorative Patches/Sachets 980

980 decorative patches/sachets
981 giraffe head of decorative patches/sachets 980
982 cat of decorative patches/sachets 980
983 dog head of decorative patches/sachets 980
984 dog of decorative patches/sachets 980
985 cat head of decorative patches/sachets 980

5. DETAILED DESCRIPTION OF THE PREFERRED EMBODIMENTS

A. General

Referring now to the figures, in which like numerals indicate like parts, and particularly to FIG. 1, which is a diagrammatic perspective view of the aesthetically and size customizable sheet/blanket/spread/comforter of an embodiment of the present invention on a bed, the aesthetically and size customizable sheet/blanket/spread/comforter of an embodiment of the present invention is shown generally at 20 for a bed 22.

B. Overall Configuration of the Ascetically Aesthetically and Size Customizable Sheet/Blanket/Spread/Comforter 20.

Figure 2:
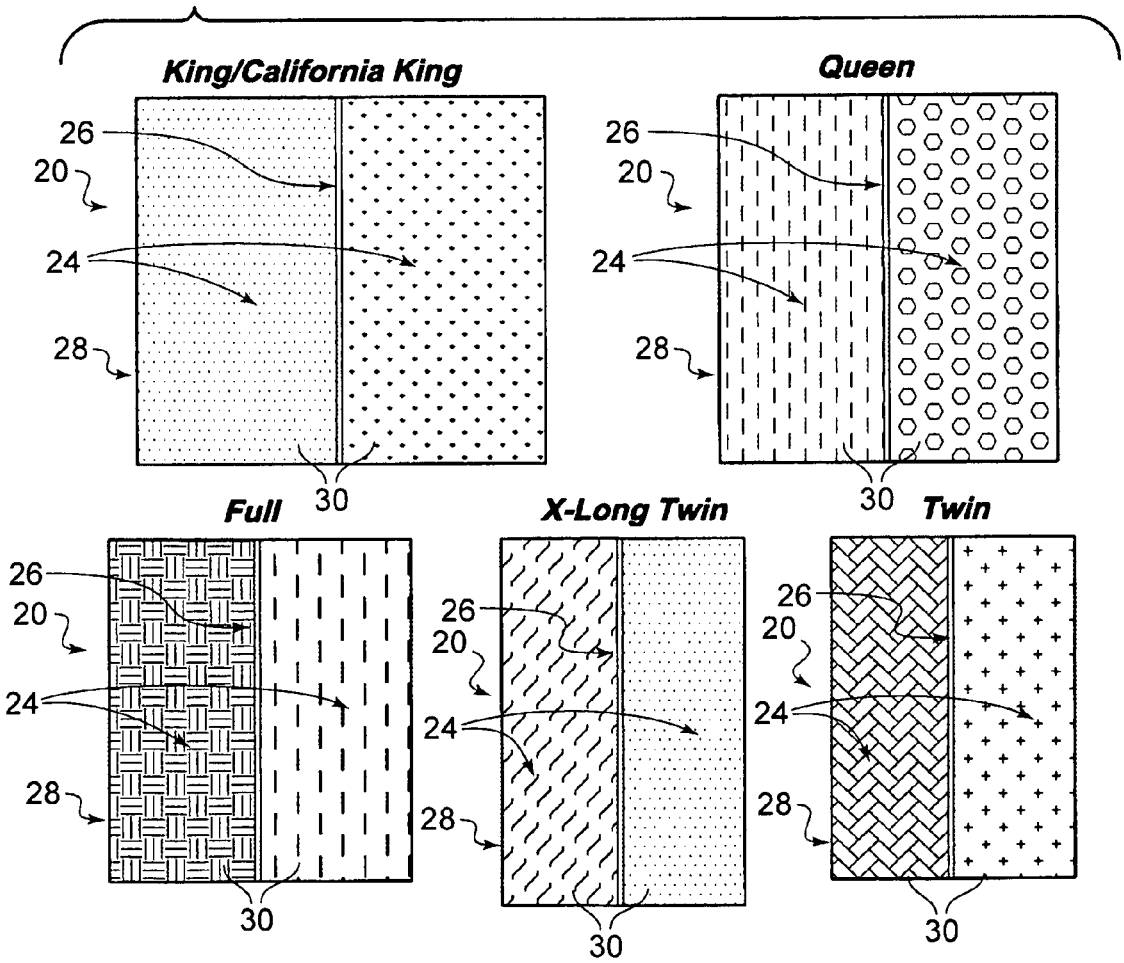
FIG. 2 are the aesthetically and size customizable sheets/blankets/spreads/comforters of an embodiment of the present invention as identified by ARROW 2 in FIG. 1 utilizing a pair of separate sections to accommodate different sized beds.
Figure 3:
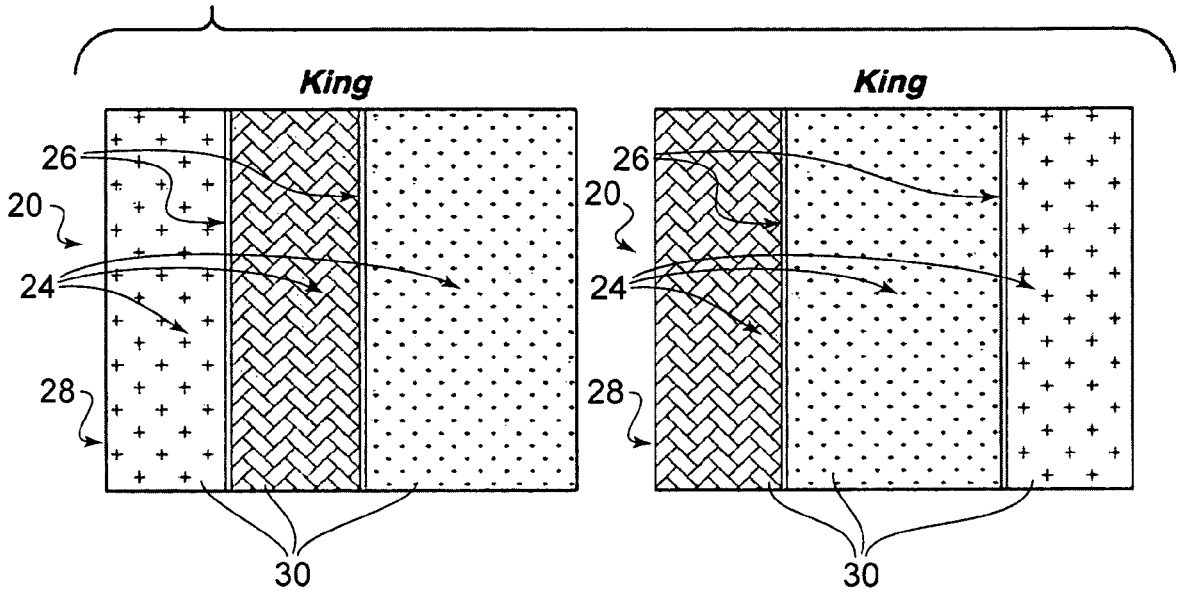
FIG. 3 are the aesthetically and size customizable sheets/blankets/spreads/comforters of an embodiment of the present invention as identified by ARROW 3 in FIG. 1 utilizing three separate sections to accommodate different sized beds.

The overall configuration of the aesthetically and size customizable sheet/blanket/spread/comforter 20 can best be seen in FIGS. 2 and 3, which are, respectively, the aesthetically and size customizable sheets/blankets/spreads/comforters of an embodiment of the present invention as identified by ARROW 2 in FIG. 1 utilizing a pair of separate sections to accommodate different sized beds, and the aesthetically and size customizable sheets/blankets/spreads/comforters of an embodiment of the present invention as identified by ARROW 3 in FIG. 1 utilizing three separate sections to accommodate different sized beds, and as such, will be discussed with reference thereto.

The aesthetically and size customizable sheet/blanket/spread/comforter 20 comprises at least two sheet sections 24 and attaching apparatus 26. The at least two sheet sections 24 are interchangeably attached to each other edge-to-edge to form a generally coplanar sheet 28 so as to allow the generally coplanar sheet 28 to be size customizable, and have decorative patterns 30 thereon so as to allow the generally coplanar sheet 28 to be aesthetically customizable. The attaching apparatus 26 is for interchangeably attaching the at least two sheet sections 24 to each other edge-to-edge to form the generally coplanar sheet 28 so as to allow the generally coplanar sheet 28 to be size customizable.

The decorative pattern 30 for each sheet section 24 is either the same or different.

As can be seen in FIG. 2, the standard sized sheets—King, California King, Queen, Full, X-Long Twin, and Twin—are formed by utilizing two of the at least two sheet sections 24 so as to allow the coplanar sheet 28 to be size customizable.

As can be seen in FIG. 3, the King sized sheets are formed by utilizing three of the at least two sheet sections 24 so as to allow the coplanar sheet 28 to be size customizable.

C. Specific Configuration of a First Embodiment of the Attaching Apparatus 126

Figure 4:
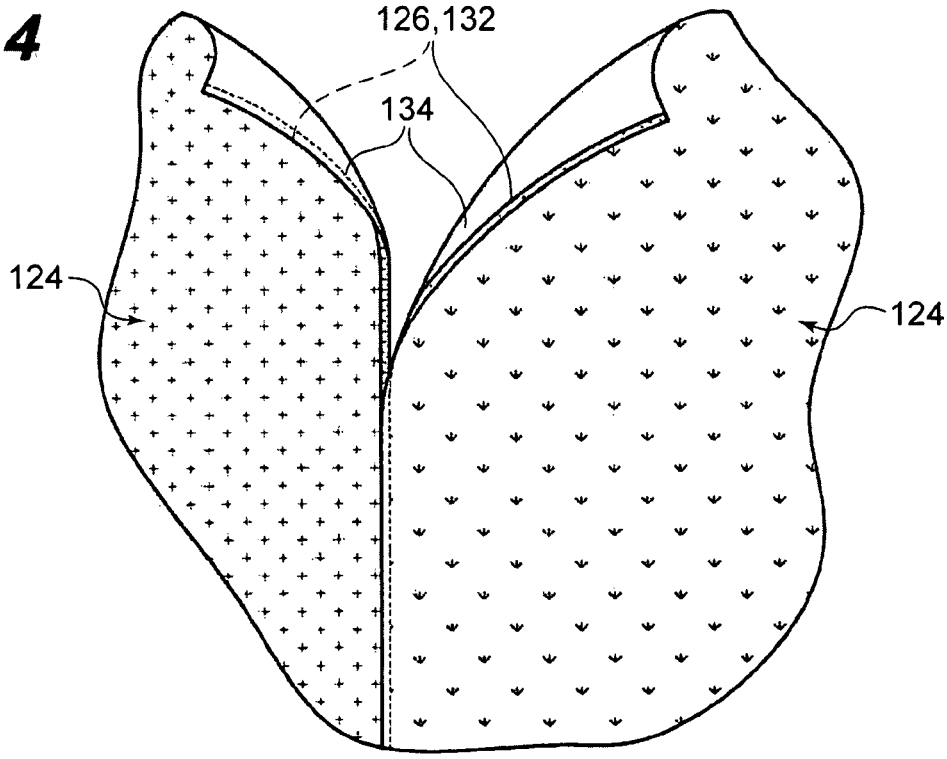
FIG. 4 is a diagrammatic perspective view of a magnetic tape mechanism of the attaching apparatus of the present invention identified by ARROW 4 in FIG. 1.

The specific configuration of a first embodiment of the attaching apparatus 126 can best be seen in FIG. 4, which is a diagrammatic perspective view of a magnetic tape mechanism of the attaching apparatus of the present invention identified by ARROW 4 in FIG. 1, and as such, will be discussed with reference thereto.

The attaching apparatus 126 comprises a magnetic tape mechanism 132. The magnetic tape mechanism 132 of the attaching apparatus 126 is disposed along adjoining edges 134 of the at least two sheet sections 124.

D. Specific Configuration of a Second Embodiment of the Attaching Apparatus 226

Figure 5:
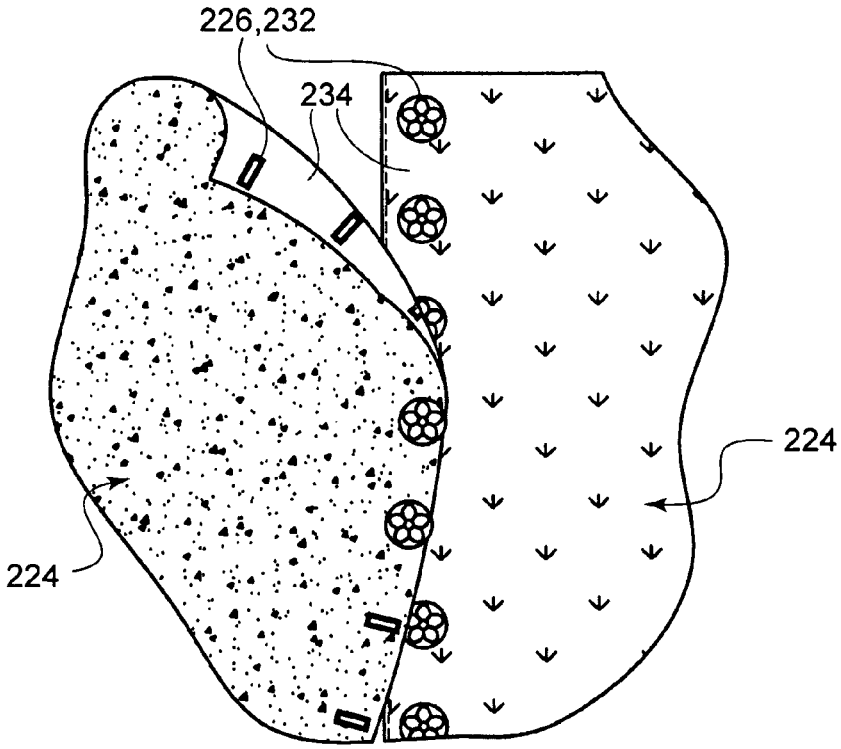
FIG. 5 is a diagrammatic perspective view of a set of button and button hole mechanisms of the attaching apparatus of the present invention identified by ARROW 5 in FIG. 1.

The specific configuration of a second embodiment of the attaching apparatus 226 can best be seen in FIG. 5, which is a diagrammatic perspective view of a set of button and button hole mechanisms of the attaching apparatus of the present invention identified by ARROW 5 in FIG. 1, and as such, will be discussed with reference thereto.

The attaching apparatus 226 comprises a set of button and button hole mechanisms 232. The set of button and button hole mechanisms 232 of the attaching apparatus 226 are disposed along adjoining edges 234 of the at least two sheet sections 224.

E. Specific Configuration of a Third Embodiment of the Attaching Apparatus 326

Figure 6A:
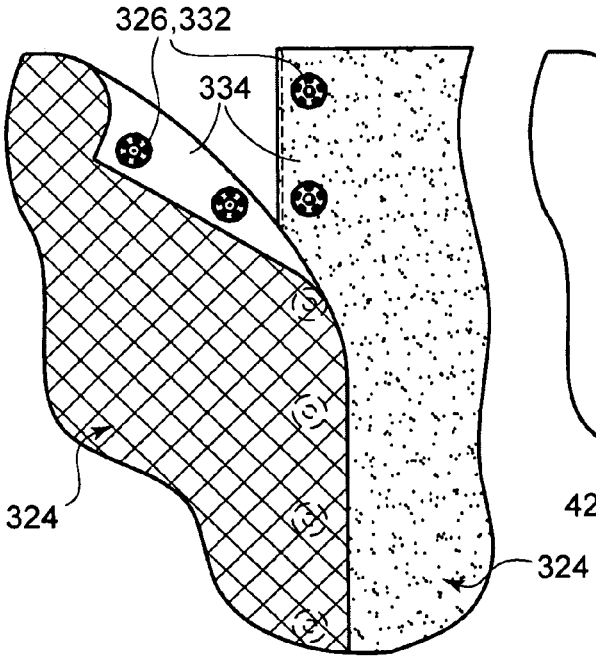
FIG. 6A is a diagrammatic perspective view of a hidden set of snap fastener mechanisms of the attaching apparatus of the present invention identified by ARROW 6A in FIG. 1.

The specific configuration of a third embodiment of the attaching apparatus 326 can best be seen in FIG. 6A, which is a diagrammatic perspective view of a hidden set of snap fastener mechanisms of the attaching apparatus of the present invention identified by ARROW 6A in FIG. 1, and as such, will be discussed with reference thereto.

The attaching apparatus 326 comprises a hidden set of snap fastener mechanisms 332. The hidden set of snap fastener mechanisms 332 of the attaching apparatus 326 are disposed along adjoining edges 334 of the at least two sheet sections 324.

F. Specific Configuration of a Fourth Embodiment of the Attaching Apparatus 426

Figure 6B:
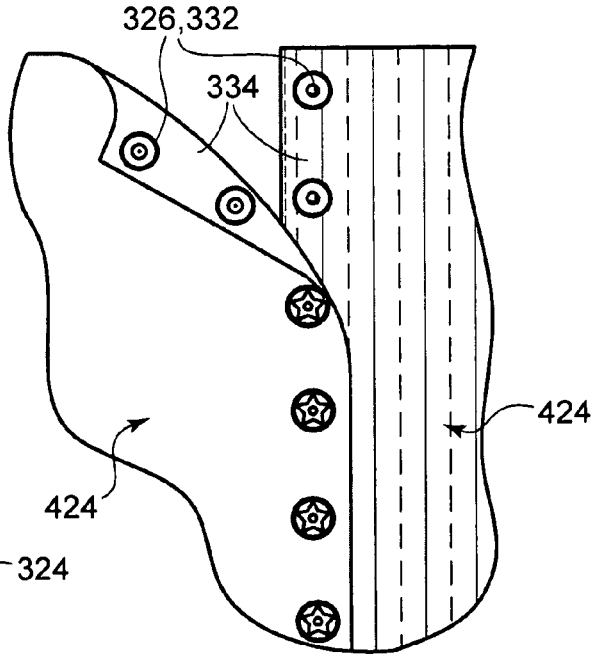
FIG. 6B is a diagrammatic perspective view of a decorative set of snap fastener mechanisms of the attaching apparatus of the present invention identified by ARROW 6B in FIG. 1.

The specific configuration of a fourth embodiment of the attaching apparatus 426 can best be seen in FIG. 6B, which is a diagrammatic perspective view of a decorative set of snap fastener mechanisms of the attaching apparatus of the present invention identified by ARROW 6B in FIG. 1, and as such, will be discussed with reference thereto.

The attaching apparatus 426 comprises a decorative set of snap fastener mechanisms 432. The decorative set of snap fastener mechanisms 432 of the attaching apparatus 426 are disposed along adjoining edges 434 of the at least two sheet sections 424.

G. Specific Configuration of a Fifth Embodiment of the Attaching Apparatus 526

The specific configuration of a fifth embodiment of the attaching apparatus 526 can best be seen in FIG. 7, which is a diagrammatic perspective view of a set of individual magnet fastener mechanisms of the attaching apparatus of the present invention identified by ARROW 7 in FIG. 1, and as such, will be discussed with reference thereto.

The attaching apparatus 526 comprises a set of individual magnet fastener mechanisms 532. The set of individual magnet fastener mechanisms 532 of the attaching apparatus 526 are disposed along adjoining edges 534 of the at least two sheet sections 524.

H. Specific Configuration of a Sixth Embodiment of the Attaching Apparatus 626

The specific configuration of a sixth embodiment of the attaching apparatus 626 can best be seen in FIGS. 8 and 8A, which are, respectively, a diagrammatic perspective view of a fastening tape mechanism of the attaching apparatus of the present invention identified by ARROW 8 in FIG. 1, and an enlarged diagrammatic plan view of the area generally enclosed by the dotted curve identified by ARROW 8A in FIG. 8, and as such, will be discussed with reference thereto.

The attaching apparatus 626 comprises a fastening tape mechanism 632. The fastening tape mechanism 632 of the attaching apparatus 626 are disposed along adjoining edges 634 of the at least two sheet sections 624.

I. Specific Configuration of a Seventh Embodiment of the Attaching Apparatus 726

Figure 9:
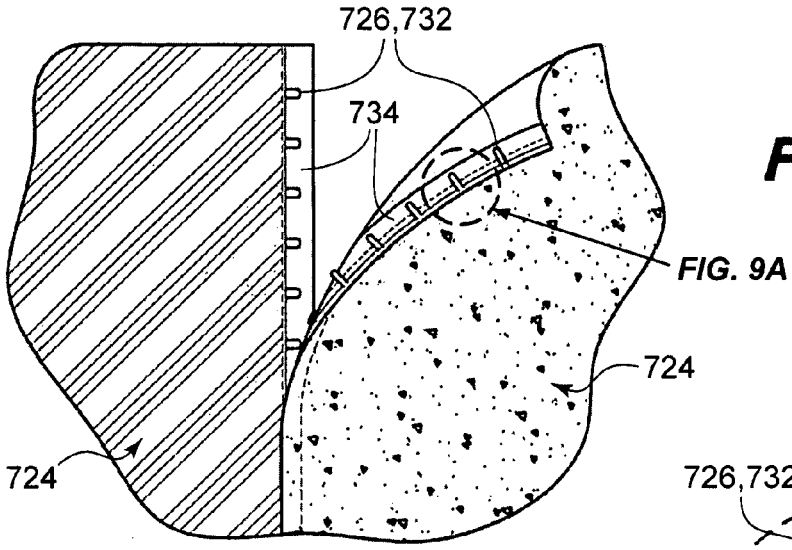
FIG. 9 is a diagrammatic perspective view of a set of individual hook and eye mechanisms of the attaching apparatus of the present invention identified by ARROW 9 in FIG. 1.
Figure 9A:
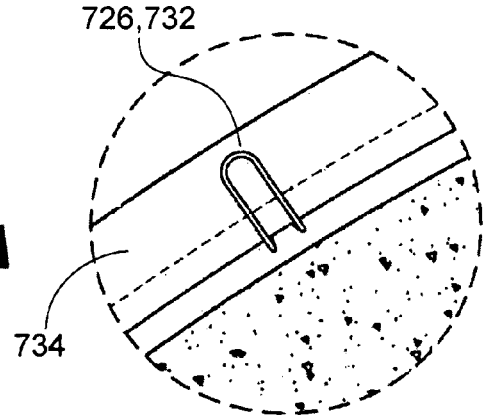
FIG. 9A is an enlarged diagrammatic plan view of the area generally enclosed by the dotted curve identified by ARROW 9A in FIG. 9.

The specific configuration of a seventh embodiment of the attaching apparatus 726 can best be seen in FIGS. 9 and 9A, which are, respectively, a diagrammatic perspective view of a set of individual hook and eye mechanisms of the attaching apparatus of the present invention identified by ARROW 9 in FIG. 1, and an enlarged diagrammatic plan view of the area generally enclosed by the dotted curve identified by ARROW 9A in FIG. 9, and as such, will be discussed with reference thereto.

The attaching apparatus 726 comprises a set of individual hook and eye mechanisms 732. The set of individual hook and eye mechanisms 732 of the attaching apparatus 726 are disposed along adjoining edges 734 of the at least two sheet sections 724.

J. Specific Configuration of an Eighth Embodiment of the Attaching Apparatus 826

Figure 10A:
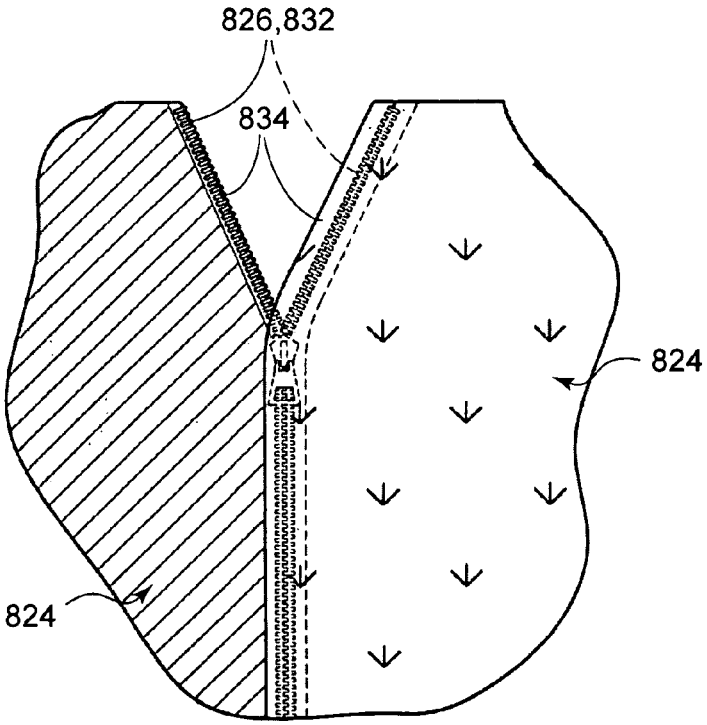
FIG. 10A is a diagrammatic perspective view of a mechanical slide fastener mechanism of the attaching apparatus of the present invention identified by ARROW 10A in FIG. 1.

The specific configuration of an eighth embodiment of the attaching apparatus 826 can best be seen in FIG. 10A, which is a diagrammatic perspective view of a mechanical slide fastener mechanism of the attaching apparatus of the present invention identified by ARROW 10A in FIG. 1, and as such, will be discussed with reference thereto.

The attaching apparatus 826 comprises a mechanical slide fastener mechanism 832. The mechanical slide fastener mechanism 832 of the attaching apparatus 826 are disposed along adjoining edges 834 of the at least two sheet sections 824.

K. Specific Configuration of a Ninth Embodiment of the Attaching Apparatus 926

Figure 10B:
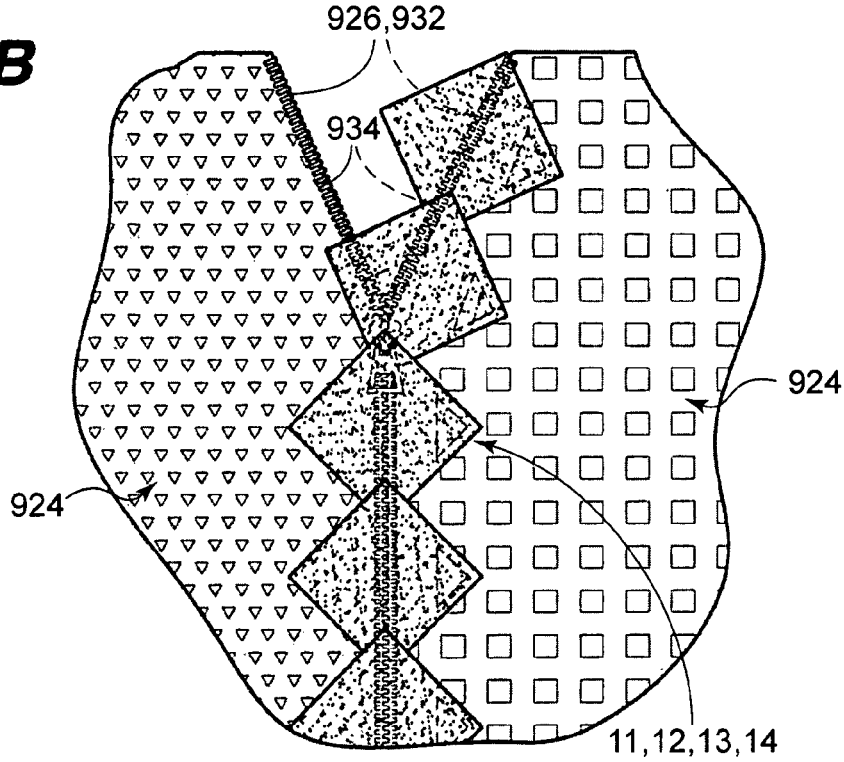
FIG. 10B is a diagrammatic perspective view of a mechanical slide fastener mechanism covered by decorative patches/sachets of the attaching apparatus of the present invention identified by ARROW 10B in FIG. 1.

The specific configuration of a ninth embodiment of the attaching apparatus 926 can best be seen in FIG. 10B, which is a diagrammatic perspective view of a mechanical slide fastener mechanism covered by decorative patches/sachets of the attaching apparatus of the present invention identified by ARROW 10B in FIG. 1, and as such, will be discussed with reference thereto.

The attaching apparatus 926 comprises a mechanical slide fastener mechanism 932 covered by decorative patches/sachets 936. The mechanical slide fastener mechanism 932 covered by decorative patches/sachets 936 of the attaching apparatus 926 is disposed along adjoining edges 934 of the at least two sheet sections 924.

L. Specific Configuration of a First Embodiment of the Decorative Patches/Sachets 950

Figure 11:
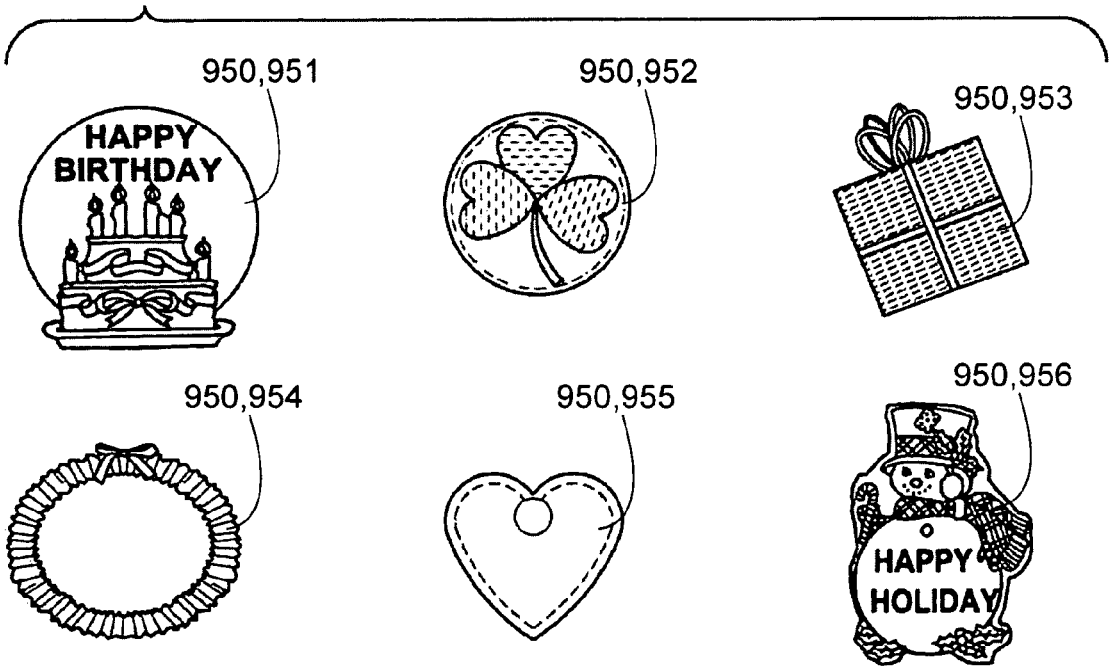
FIG. 11 is a first set of decorative holiday patches/sachets identified by ARROW 11 in FIG. 10B.

The specific configuration of a first embodiment of the decorative patches/sachets 950 can best be seen in FIG. 11, which is a first set of decorative holiday patches/sachets identified by ARROW 11 in FIG. 10B, and as such, will be discussed with reference thereto.

The decorative patches/sachets 950 are a set of decorative holiday patches/sachets. The set of decorative holiday patches/sachets of the decorative patches/sachets 950 comprise a Happy Birthday patch/sachet 951, a Saint Patty's Day patch/sachet 952, a gift patch/sachet 953, a Christmas wreath patch/sachet 954, a Valentine's Day patch/sachet 955, and a Happy Holiday patch/sachet 956.

M. Specific Configuration of a Second Embodiment of the Decorative Patches/Sachets 960

Figure 12:
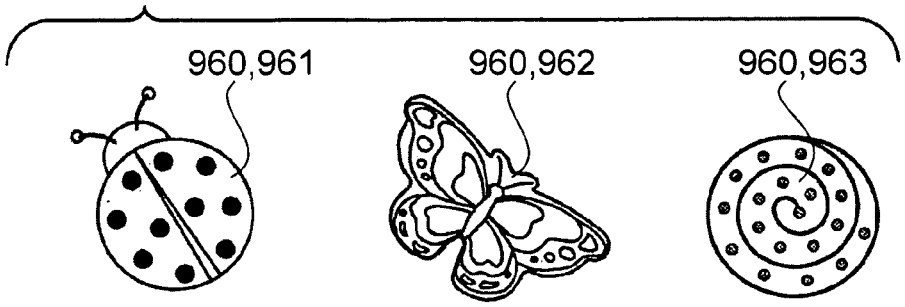
FIG. 12 is a second set of decorative insect patches/sachets identified by ARROW 12 in FIG. 10B.

The specific configuration of a second embodiment of the decorative patches/sachets 960 can best be seen in FIG. 12, which is a second set of decorative insect patches/sachets identified by ARROW 12 in FIG. 10B, and as such, will be discussed with reference thereto.

The decorative patches/sachets 960 are a set of decorative insect patches/sachets. The set of decorative insect patches/sachets of the decorative patches/sachets 960 comprise a Lady Bug patch/sachet 961, a Butterfly patch/sachet 962, and a worm patch/sachet 963.

N. Specific Configuration of a Third Embodiment of the Decorative Patches/Sachets 970

Figure 13:
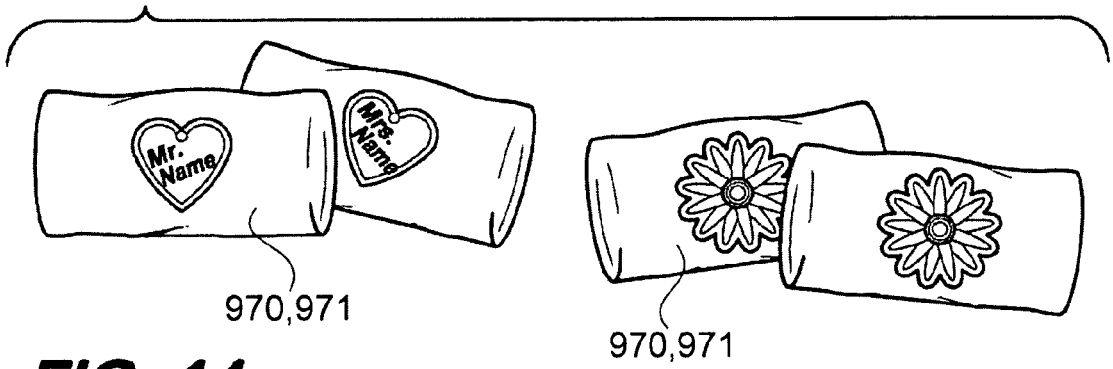
FIG. 13 is a third set of decorative puffy patches/sachets identified by ARROW 13 in FIG. 10B.

The specific configuration of a third embodiment of the decorative patches/sachets 970 can best be seen in FIG. 13, which is a third set of decorative puffy patches/sachets identified by ARROW 13 in FIG. 10B, and as such, will be discussed with reference thereto.

The decorative puffy patches/sachets 970 are a set of decorative puffy patches/sachets. The set of decorative puffy patches/sachets of the decorative patches/sachets 970 comprise pillows 971.

O. Specific Configuration of a Fourth Embodiment of the Decorative Patches/Sachets 980

Figure 14:
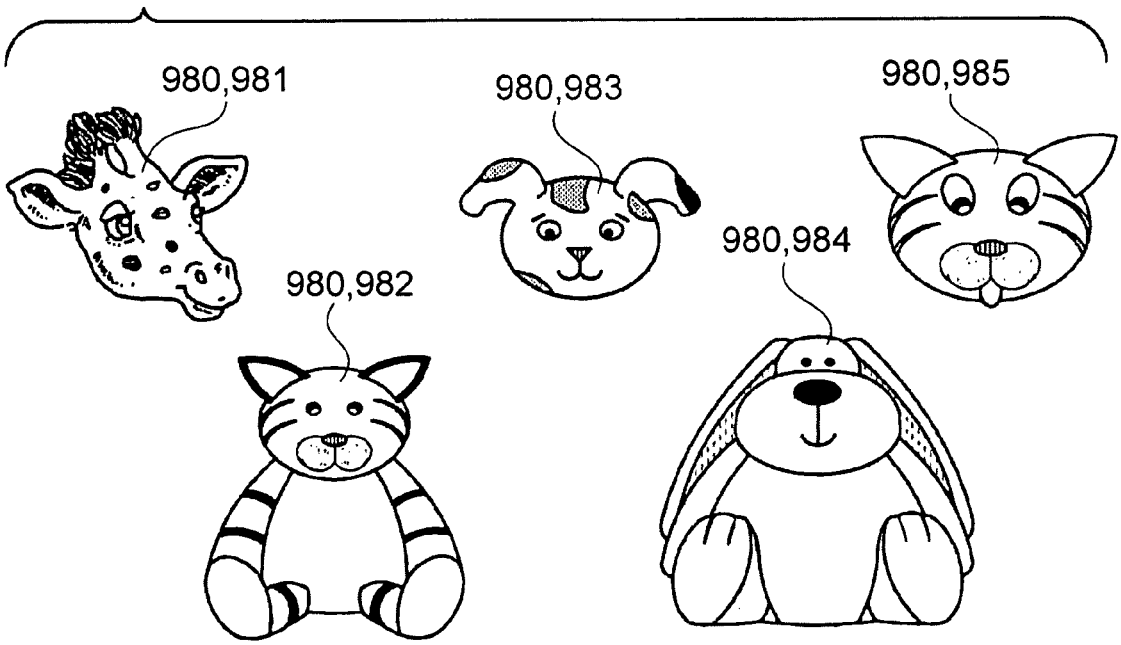
FIG. 14 is a fourth set of decorative animal patches/sachets identified by ARROW 14 in FIG. 10B.

The specific configuration of a fourth embodiment of the decorative patches/sachets 980 can best be seen in FIG. 14, which is a fourth set of decorative animal patches/sachets identified by ARROW 14 in FIG. 10B, and as such, will be discussed with reference thereto.

The decorative puffy patches/sachets 980 are a set of decorative animal patches/sachets. The set of decorative animal patches/sachets of the decorative patches/sachets 980 comprise a giraffe head 981, a cat 982, a dog head 983, a dog 984, and a cat head 985.

P. Impressions

It will be understood that each of the elements described above or two or more together may also find a useful application in other types of constructions differing from the types described above.

While the embodiments of the present invention have been illustrated and described as embodied in an aesthetically and size customizable sheet/blanket/spread/comforter for a bed, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. An aesthetically and size customizable sheet/blanket/spread/comforter for a bed, comprising:

a) at least two sheet sections; and b) means for interchangeably attaching said at least two sheet sections to each other edge-to-edge to form a generally coplanar sheet so as to allow said generally coplanar sheet to be size customizable;

wherein said at least two sheet sections are interchangeably attached to each other edge-to-edge to form the generally coplanar sheet so as to allow said generally coplanar sheet to be size customizable;

wherein said at least two sheet sections have decorative patterns thereon so as to allow said generally coplanar sheet to be aesthetically customizable;

wherein said means is covered by decorative sachets;

wherein said means includes a mechanical slide fastener mechanism covered entirely by said decorative sachets; and wherein said mechanical slide fastener mechanism covered entirely by said decorative sachets of said means is disposed along adjoining edges of said at least two sheet sections.

2. The aesthetically and size customizable sheet/blanket/spread/comforter of claim 1, wherein said decorative pattern for each sheet section is one of same and different.

3. The aesthetically and size customizable sheet/blanket/spread/comforter of claim 1, wherein said decorative sachets of said means include a set of decorative holiday sachets.

4. The aesthetically and size customizable sheet/blanket/spread/comforter of claim 3, wherein said set of decorative holiday sachets of said decorative sachets of said means comprise a Happy Birthday sachet, a Saint Patty's Day sachet, a gift sachet, a Christmas wreath sachet, a Valentine's Day sachet, and a Happy Holiday sachet.

5. The aesthetically and size customizable sheet/blanket/spread/comforter of claim 1, wherein said decorative sachets of said means include a set of decorative insect sachets.

6. The aesthetically and size customizable sheet/blanket/spread/comforter of claim 5, wherein said set of decorative insect sachets of said decorativesachets of said means comprise a ladybug sachet, a butterfly sachet, and a worm sachet.

7. The aesthetically and size customizable sheet/blanket/spread/comforter of claim 1, wherein said decorative sachets of said means include a set of decorative puffy sachets.

8. The aesthetically and size customizable sheet/blanket/spread/comforter of claim 7, wherein said set of decorative puffy sachets of said decorative sachets of said means comprise a pillow sachet.

9. The aesthetically and size customizable sheet/blanket/spread/comforter of claim 1, wherein said decorative sachets of said means include a set of decorative animal sachets.

10. The aesthetically and size customizable sheet/blanket/spread/comforter of claim 9, wherein said set of decorative animal sachets of said decorative sachets of said means comprise a giraffe head sachet, a cat head sachet, a dog head sachet, a dog sachet, and a cat sachet.

* * * * *